US010626703B2

(12) United States Patent
Johnson

(10) Patent No.: US 10,626,703 B2
(45) Date of Patent: Apr. 21, 2020

(54) SAFETY VALVE COUPLING AND METHOD OF MANUFACTURING VALVE

(71) Applicant: Jeffrey Johnson, Bixby, OK (US)

(72) Inventor: Jeffrey Johnson, Bixby, OK (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 261 days.

(21) Appl. No.: 15/814,621

(22) Filed: Nov. 16, 2017

(65) Prior Publication Data

US 2019/0145188 A1 May 16, 2019

(51) Int. Cl.

| | |
|---|---|
| ***E21B 34/14*** | (2006.01) |
| *E21B 17/05* | (2006.01) |
| *E21B 34/00* | (2006.01) |
| *E21B 34/12* | (2006.01) |
| *E21B 34/10* | (2006.01) |

(52) U.S. Cl.

CPC ..... *E21B 34/14* (2013.01); *E21B 17/05* (2013.01); *E21B 34/105* (2013.01); *E21B 34/12* (2013.01); *E21B 2034/005* (2013.01)

(58) Field of Classification Search

CPC .. E21B 34/10; E21B 34/105; E21B 2034/005; E21B 34/14

See application file for complete search history.

(56) References Cited

U.S. PATENT DOCUMENTS

| | | | | |
|---|---|---|---|---|
| 4,629,002 | A * | 12/1986 | Pringle | E21B 34/101 166/324 |
| 4,945,993 | A | 8/1990 | Dickson et al. | |
| 9,470,064 | B2 | 10/2016 | Kucera | |
| 2002/0108747 | A1 | 8/2002 | Dietz et al. | |
| 2011/0037004 | A1 | 2/2011 | Lake et al. | |
| 2013/0199791 | A1 | 8/2013 | Hill, Jr. et al. | |
| 2016/0010430 | A1 | 1/2016 | Myerley et al. | |

FOREIGN PATENT DOCUMENTS

WO WO2004031534 A1 4/2004

OTHER PUBLICATIONS

International Search Report and Written Opinion for PCT/US2018/055532; International Filing Date Oct. 12, 2018; Report dated Jan. 25, 2019 (pp. 1-7).

"Technical Specification Sheet", Product No. H82634; Baker Hughes, 2016, 1 page.

* cited by examiner

*Primary Examiner* — Kristyn A Hall
(74) *Attorney, Agent, or Firm* — Cantor Colburn LLP

(57) ABSTRACT

A valve includes a piston, a flow tube, and a coupling transferring longitudinal movement between the piston and flow tube and enabling rotational movement of the flow tube with respect to the piston. The coupling includes a connector and a thrust sleeve. The connector includes a piston attachment feature and a thrust sleeve attachment feature, the piston attachment feature attached to the piston. The thrust sleeve includes a pocket, the thrust sleeve attachment feature disposed within the pocket. The thrust sleeve includes portions disposed radially interiorly and radially exteriorly of the thrust sleeve attachment feature.

20 Claims, 5 Drawing Sheets

SAFETY VALVE COUPLING AND METHOD OF MANUFACTURING VALVE

BACKGROUND

In the resource recovery industry, resources (such as hydrocarbons, steam, minerals, water, metals, etc.) are often recovered from boreholes in formations containing the targeted resource.

Generally, when running a tubing string downhole, it is desirable, and in some cases required, to include a safety valve on the tubing string. The safety valve typically has a fail-safe design whereby the valve will automatically close to prevent production fluid from flowing through the tubing, should, for example, the surface production equipment be damaged or malfunction.

Should the safety valve become inoperable, the safety valve may be retrieved to surface. The tubing retrievable surface controlled subsurface safety valve ("TRSV") is attachable to production tubing string and includes a flapper pivotally mountable on the lower end of the safety valve assembly, and biased in the closed position to prevent fluid flow through the tubing string. When fully closed, the flapper seals off the inner diameter of the TRSV preventing fluid flow therethrough. A flow tube is provided above the flapper to open the flapper. The flow tube is adapted to be movable axially within the TRSV. When the flapper is closed, the flow tube is in its uppermost position; when the flow tube is in a lowered position, the lower end of the flow tube operates to extend through the TRSV and pivotally open the flapper. When the flow tube is in the lowered position and the flapper is open, fluid communication through the TRSV is allowed. To move the flow tube to the lowered position, a piston rod is engaged with the flow tube. The piston rod is located in a hydraulic piston chamber within the TRSV. The upper end of the chamber is in fluid communication, via a control line, with a hydraulic fluid source and pump at the surface. Seals are provided such that when sufficient control fluid (e.g. hydraulic fluid) pressure is supplied from surface, the piston rod moves downwardly in the chamber, thus forcing the flow tube downwardly, against the bias of a power spring, towards the flapper to open the TRSV. When the control fluid pressure is removed, the piston rod and flow tube move upwardly by the power spring, allowing the flapper to move to its biased closed position.

Due to the potential for the flow tube to rotate during longitudinal translation through the TRSV, the coupling between the flow tube and the piston rod must allow for flow tube rotation, while ensuring that the piston rod is protected from rotational loads due to its confinement within the piston chamber. The piston rod has been connected to the flow tube with a stop seal which fits under a thrust sleeve and is retained in the thrust sleeve by the outer diameter of the flow tube. However, in extreme cases, the stop seal can 'pull through' from the thrust sleeve.

The art would be receptive to alternative and improved valves and methods to manufacture valves in the resource recovery industry.

SUMMARY

A valve includes a piston, a flow tube, and a coupling transferring longitudinal movement between the piston and flow tube and enabling rotational movement of the flow tube with respect to the piston. The coupling includes a connector and a thrust sleeve. The connector includes a piston attachment feature and a thrust sleeve attachment feature, the piston attachment feature attached to the piston. The thrust sleeve includes a pocket, the thrust sleeve attachment feature disposed within the pocket. The thrust sleeve includes portions disposed radially interiorly and radially exteriorly of the thrust sleeve attachment feature.

A method of forming a valve includes additively manufacturing a valve coupling with a connector and a thrust sleeve, the connector having a piston attachment feature and a thrust sleeve attachment feature, and the thrust sleeve having a pocket, the thrust sleeve attachment feature formed within the pocket during additive manufacturing of the valve coupling; attaching the piston attachment feature to a piston; and attaching the thrust sleeve to a lower coupling; wherein the valve coupling transfers longitudinal movement between the piston and flow tube and enables rotational movement of the flow tube with respect to the piston.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
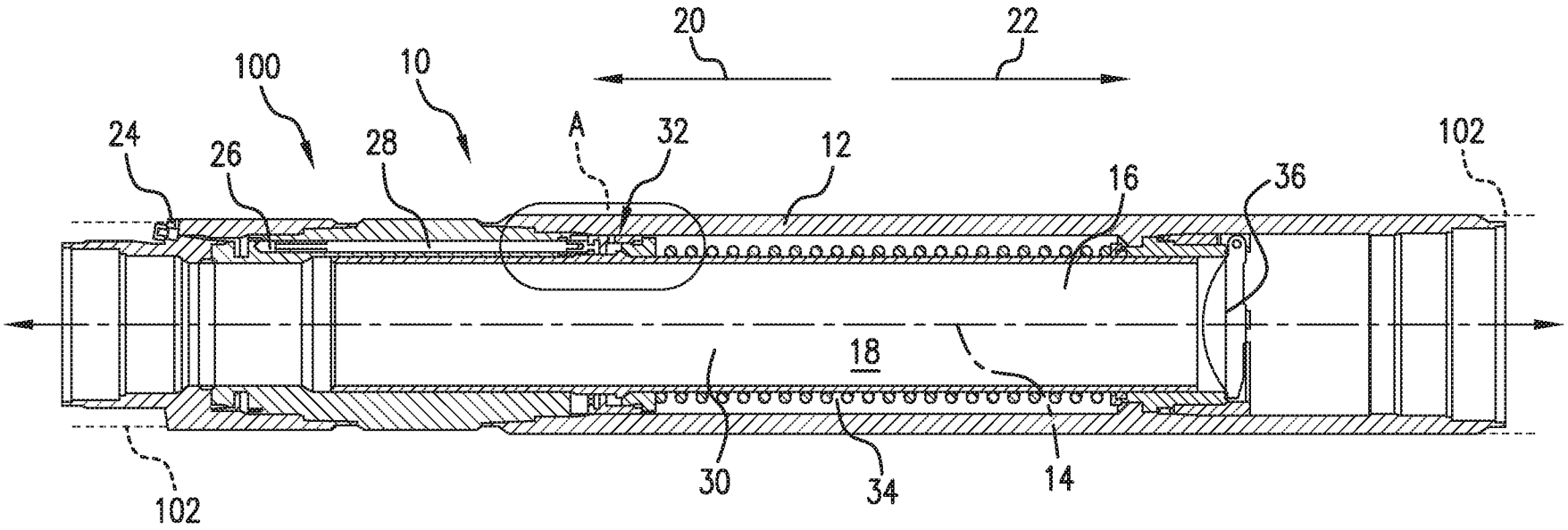
FIG. 1 depicts a sectional view of an embodiment of a downhole system including an embodiment of a tubing retrievable safety valve ("TRSV")

As shown in FIG. 1, one embodiment of a tubing retrievable surface controlled subsurface safety valve ("TRSV") 10 is shown as part of a downhole system 100. The downhole system 100 includes, in addition to the TRSV 10, any number of connections and tubulars 102, such as those that may be required for downhole use. The TRSV 10 includes a tubular housing 12 that may be formed by a number of housing units. The housing 12 is tubular in shape surrounding the longitudinal axis 14 of the TRSV 10 such that an interior 16 of the housing 12 of the TRSV 10 provides a flow path 18, which can direct fluids in either an uphole direction 20 for production and extraction of natural resources or downhole direction 22 for injection of fluids and/or treatment.

The housing 12 further includes a hydraulic communication port 24 for conveying hydraulic control pressure, such as from a hydraulic control line (not shown), from the wellhead or other remote location or chamber to the TRSV 10. The hydraulic communication port 24 is in fluid communication with a piston chamber 26 sized to sealingly hold a piston 28. Linear movement of the piston 28, due to hydraulic pressure at or greater than a predetermined pressure, actuates a flow tube 30 via a valve coupling 32, as will be further described below.

A portion of the housing 12 additionally houses a power spring 34 and a movable flow path blocking member, such as a flapper 36. While the movable flow path blocking member of the TRSV 10 is illustrated as flapper 36, alternatively a ball valve, or other types of valves may be incorporated in the TRSV 10. The flapper 36 is biased to the closed position, such as by a torsion spring. When hydraulic pressure is received through the hydraulic communication port 24, the piston 28 moves in the downhole direction 22. Due to the coupling 32 that couples the piston 28 to the flow tube 30, the flow tube 30 moves in the downhole direction 22 with the piston 28, compressing the power spring 34. The downhole end of the flow tube 30 abuts with the flapper 36 to pivot the flapper 36 towards the wall of the housing 12 to open the flow path 18, thus allowing for passage of fluid therethrough, as well as other downhole objects and tools. The TRSV 10 must be able to fail into the closed position; that is to say, the power spring 34 must be able to lift the flow tube 30 (and any other moving parts) against the hydrostatic force of the hydraulic control fluid from the surface. If there is a loss of hydraulic pressure at the hydraulic communication port 24, intentional or otherwise, the flow tube 30 will be pushed back in the uphole direction 20, due to the power spring 34 and the coupling 32, allowing the flapper 36 to move to its biased closed position and close off the flow path 18 (as shown in FIG. 1). During longitudinal movement of the flow tube 30, in either direction, the flow tube 30 may rotate about the longitudinal axis 14 of the TRSV 10. Since the piston 28 is prohibited from rotating about the longitudinal axis due to entrapment within the piston chamber 26, the coupling 32 that couples the piston 28 to the flow tube 30 must allow for the rotation of the flow tube 30 while transmitting longitudinal movement of the piston 28 to the flow tube 30, and of the flow tube 30 to the piston 28.

Figure 2:
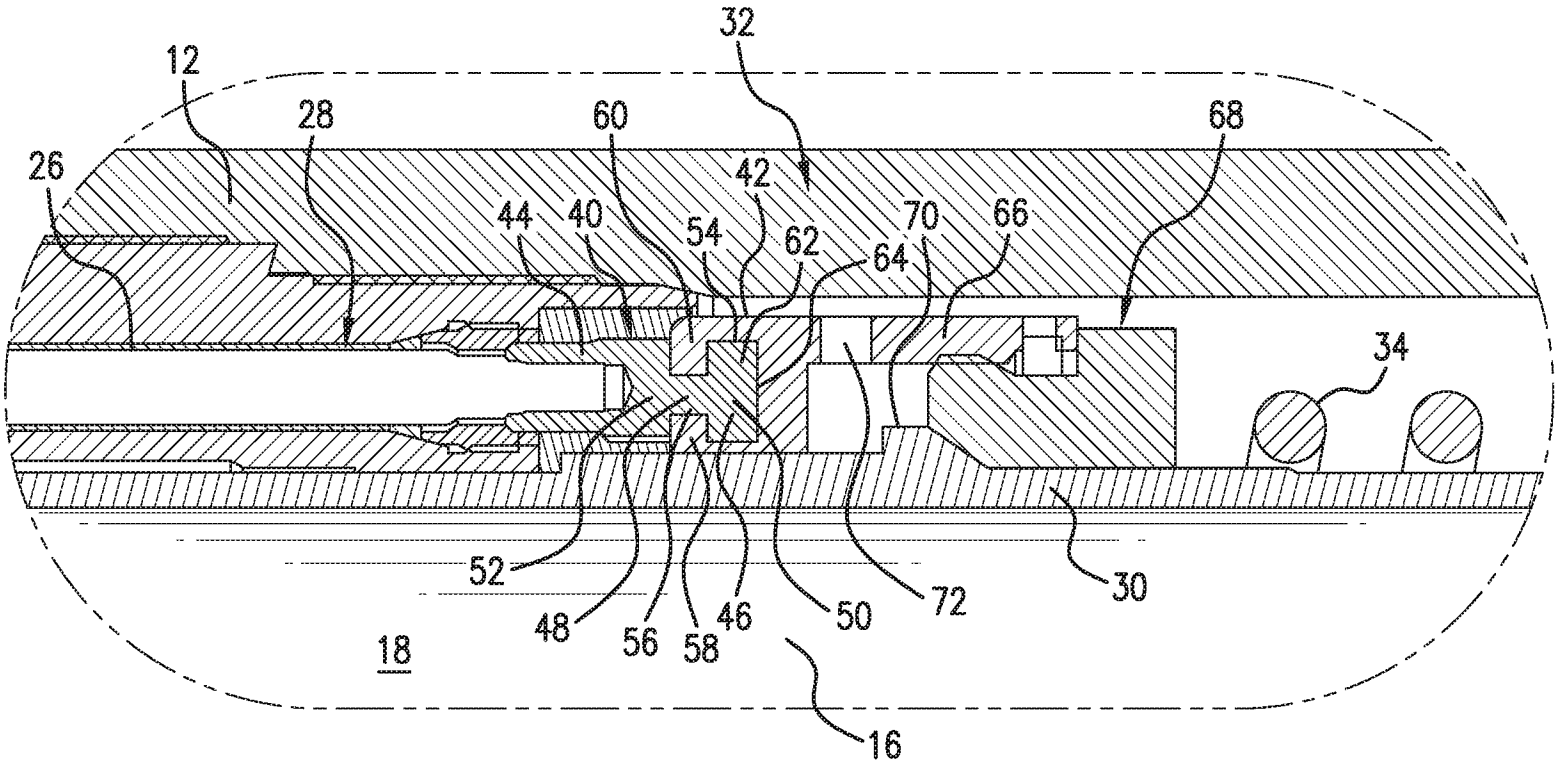
FIG. 2 depicts an enlarged view of area A within FIG. 1.
Figure 3:
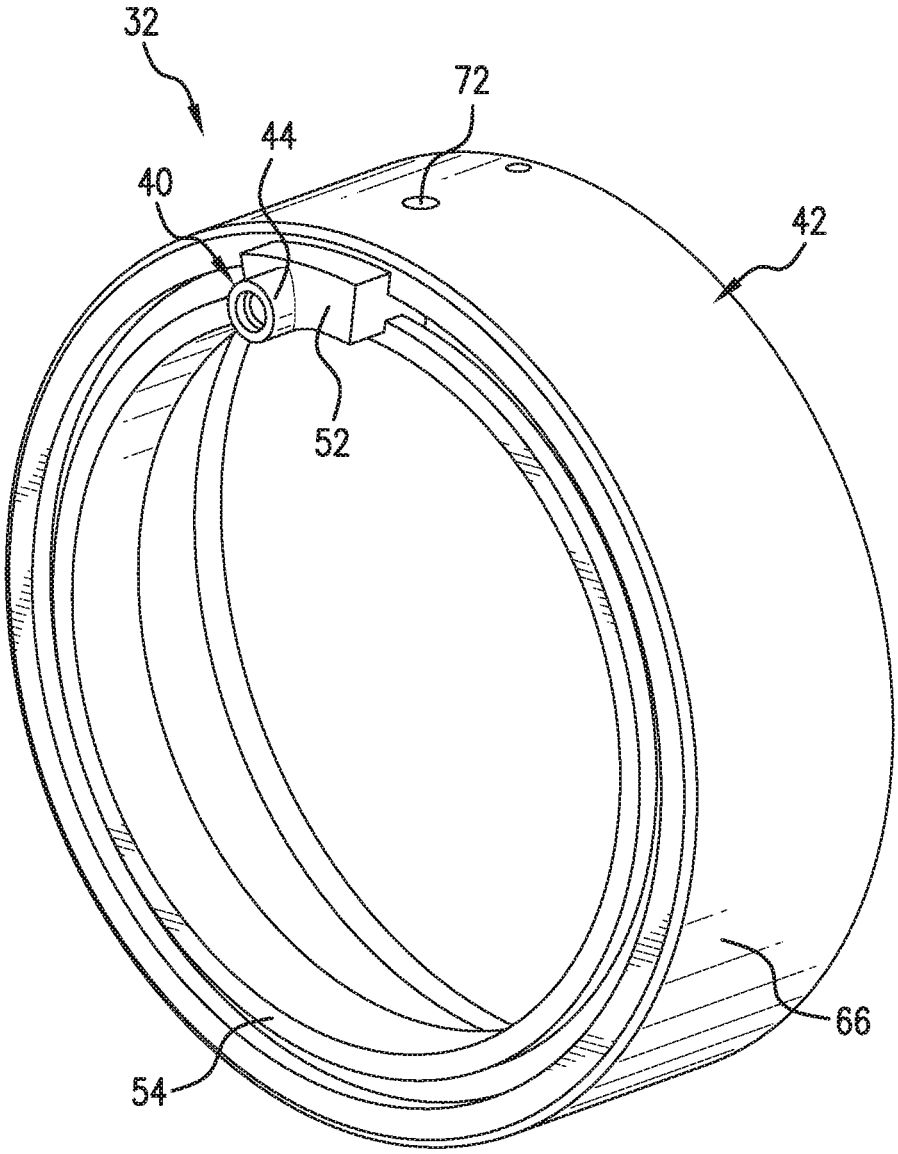
FIG. 3 depicts a perspective view of an embodiment of a coupling for the TRSV of FIG. 1.
Figure 4:
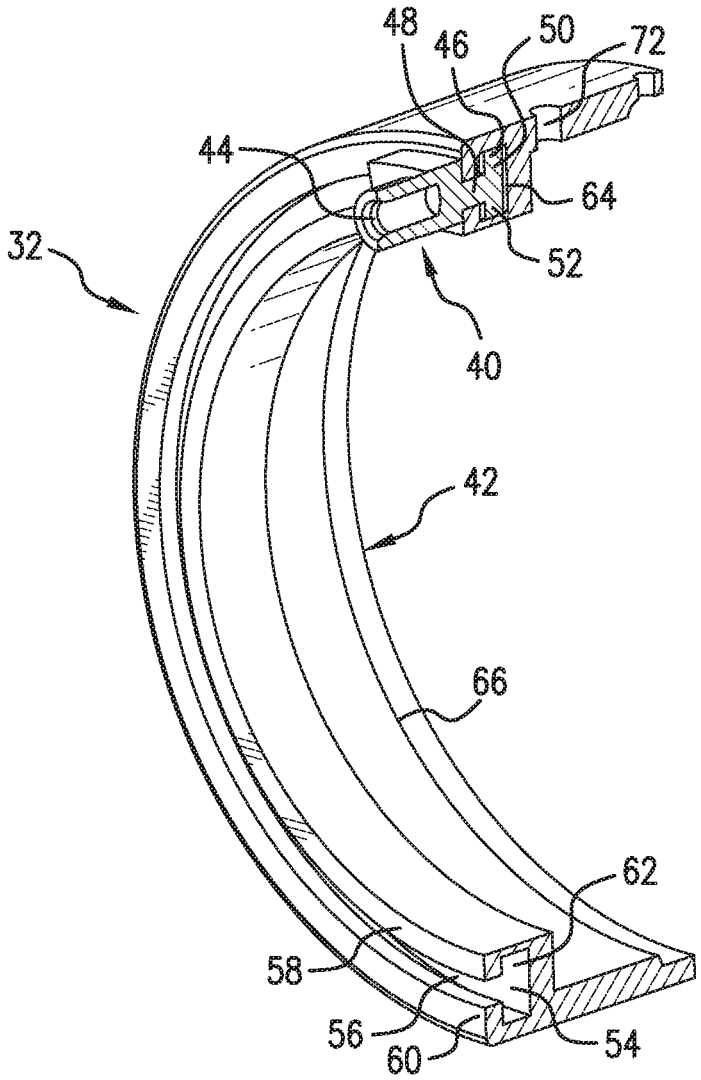
FIG. 4 depicts a perspective and sectional view of the coupling of FIG. 3.
Figure 5:
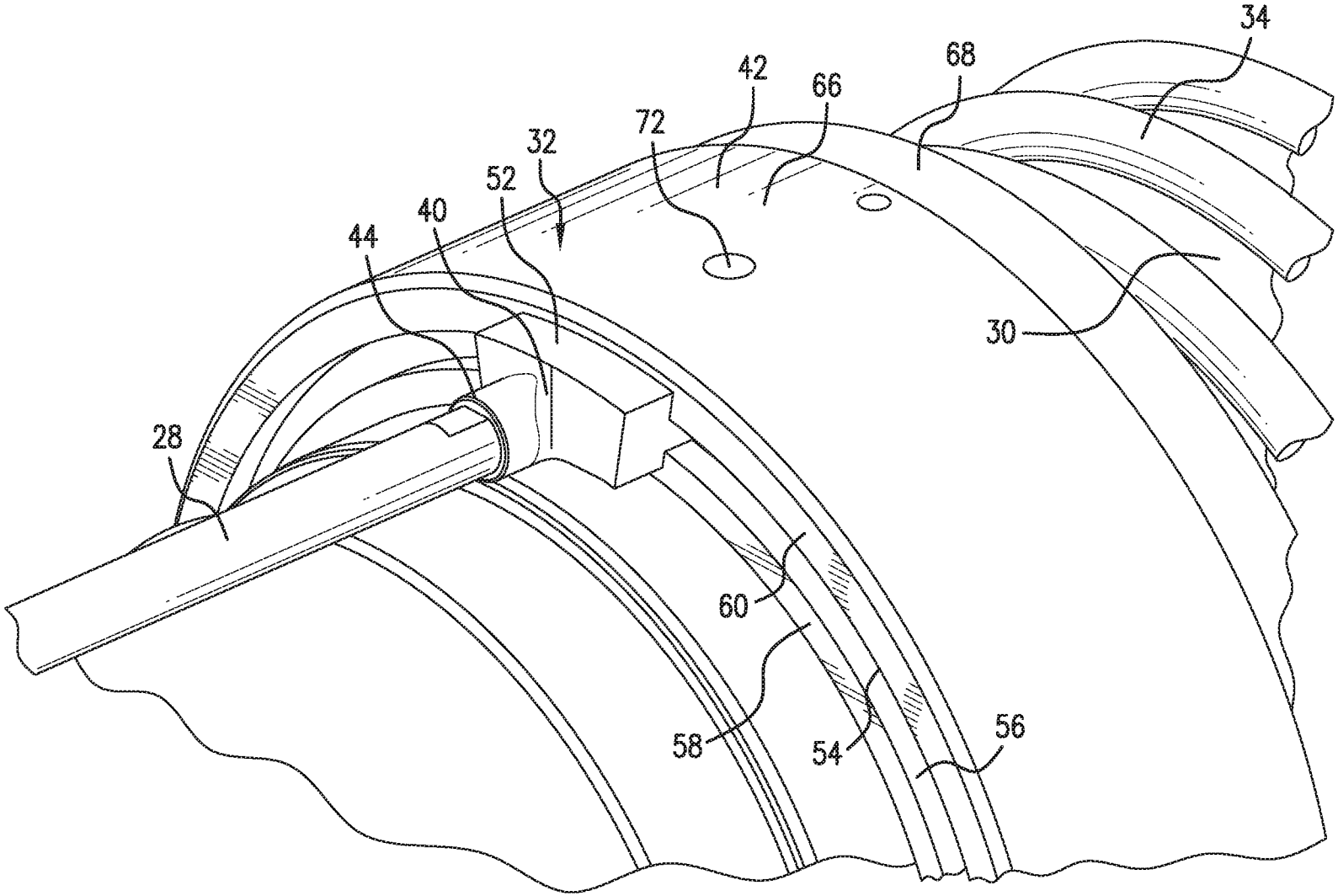
FIG. 5 depicts a perspective view of the coupling of FIG. 3 as included within the TRSV of FIG. 1.

The coupling 32 includes a connector 40 and a thrust sleeve 42. The connector 40 is attached to a downhole end of the piston 28 by a piston attachment feature 44 of the connector 40, such as, but not limited to a threaded connection. In the illustrated embodiment, the piston attachment feature 44 includes a female threaded portion for receipt of a male threaded portion of the piston 28. The connector 40 also includes a thrust sleeve attachment feature 46, which, as best shown in FIGS. 2 and 4, may be a T-shaped member, although other shapes may be included such as a dove-tailed shape. The thrust sleeve attachment feature 46 includes a first section 48 having a first length and a second section 50 having a second length greater than the first length, where the first and second lengths are measured radially outwardly from the longitudinal axis 14. The connector 40 further includes a mid-section 52 connecting the piston attachment feature 44 to the thrust sleeve attachment feature 46, the mid-section 52 having a third length greater than the first length.

The thrust sleeve 42 of the coupling 32 is tubular shaped and concentric with the flow tube 30. The thrust sleeve 42 includes a pocket 54 for the thrust sleeve attachment feature 46. The pocket 54 longitudinally traps the thrust sleeve attachment feature 46 within the thrust sleeve 42 such that the thrust sleeve 42 and the connector 40 move longitudinally together. The pocket 54 also allows rotational movement of the thrust sleeve 42 relative to the connector 40. The pocket 54 may have a sectional shape that is substantially the same as, but slightly larger than, the sectional shape of the thrust sleeve attachment feature 46. However, the sectional shape of the pocket 54 extends concentrically within the body of the thrust sleeve 42. The pocket 54 includes a throat section 56 having a radially interior lip 58 that is radially interior to the first section 48 of the thrust sleeve attachment feature 46 and a radially exterior lip 60 that is positioned radially exterior to the first section 48 of the thrust sleeve attachment feature 46. The lips 58, 60 are longitudinally disposed between the mid-section 52 of the connector 40 and the second section 50 of the thrust sleeve attachment feature 46. The pocket 54 also includes a second section receiving portion 62, which further surrounds the second section 50 at both radial interior and exterior sides of the second section 50, as well as a longitudinal downhole side 64 of the second section 50. Thus, the thrust sleeve attachment feature 46 of the connector 40 is flanked radially interiorly and radially exteriorly by the thrust sleeve 42.

The thrust sleeve 42 further includes an extension 66 that extends longitudinally from the pocket 54. The TRSV 10 further includes a lower coupling 68, or alternatively an intermediate coupling or second coupling, where the valve coupling 32 may alternatively be referred to as a main coupling or first coupling. The thrust sleeve 42 and lower coupling 68 may be threaded together to trap an upset 70 of the flow tube 30, that is longitudinally disposed uphole of the lower coupling 68 and within a space radially interior of the extension 66. The extension 66 may include one or more radial apertures 72 for receiving a set screw to lock the threads together and secure the thrust sleeve 42 to the flow tube 30. The lower coupling 68 can also serve to transfer longitudinal movement between the coupling 32 and the flow tube 30. As illustrated, the lower coupling 68 provides a face to engage with the uphole end of the power spring 34.

The connection between the connector 40 and the thrust sleeve 42 is made possible by using an additive manufacturing method, and therefore the connector 40 and the thrust sleeve 42 can be produced as a single assembly and can be produced simultaneously using the additive manufacturing method. Advantageously, the need to separately manufacture the connector 40 and the thrust sleeve 42 is eliminated. In addition to the ability to create the interlocking geometry using additive manufacturing, the ability to create a more complex arc shape of the thrust sleeve attachment feature 46 of the connector 40 to increase contact area within the pocket 54 is enabled. In one embodiment of the additive manufacturing method, selective laser sintering may be used to provide a clearance between the thrust sleeve attachment feature 46 and the pocket 54, such as a few ten thousandths of an inch. The clearance may be provided with a powder that forms the coupling 32, however the laser would not burn in the powder for the clearance area, such that after cleaning the powder out of the clearance, the connector 40 is slidably movable in a circumferential direction within the thrust sleeve 42. Alternatively, temporary support structures between the connector 40 and the thrust sleeve 42 can be built while simultaneously creating the coupling 32, where such structures are subsequently removed.

The coupling 32 between the piston 28 and the flow tube 30 enables the transfer of linear motion of the piston 28 into the flow tube 30, and allows rotational movement of the flow tube 30 and thrust sleeve 42 relative to the piston 28. Additionally, due to the interlocking geometry of the connector 40 and thrust sleeve 42, the connector 40 is keyed into and longitudinally locked within the thrust sleeve 42 such that the connector 40 is inseparable from the thrust sleeve 42. The unique interlocking geometry, which includes a radially interior lip 58 as well as a radially exterior lip 60 of the thrust sleeve 42, spreads out stresses on the connection between the connector 40 and thrust sleeve 42 over nearly all outer peripheral surfaces of the thrust sleeve attachment feature 46, with the exception of the two circumferentially opposite facing surfaces which cannot be engaged with by the thrust sleeve 42 since the thrust sleeve 42 must be able to rotate in circumferential directions with respect to the thrust sleeve attachment feature 46. The coupling 32 allows stresses to distribute through the radially exterior lip 60 and the radially interior lip 58 providing a substantially even load path. Reducing stress concentrations which could cause the coupling 32 to fail will assist in increasing the reliability of the coupling 32 and thereby increase the reliability of the TRSV 10.

Set forth below are some embodiments of the foregoing disclosure:

Embodiment 1

A valve including a piston, a flow tube, and a coupling transferring longitudinal movement between the piston and flow tube and enabling rotational movement of the flow tube with respect to the piston. The coupling includes a connector and a thrust sleeve. The connector includes a piston attachment feature and a thrust sleeve attachment feature, the piston attachment feature attached to the piston. The thrust sleeve includes a pocket, the thrust sleeve attachment feature disposed within the pocket. The thrust sleeve includes portions disposed radially interiorly and radially exteriorly of the thrust sleeve attachment feature.

Embodiment 2

The valve as in any prior embodiment or combination of embodiments, wherein the connector and the thrust sleeve are additively manufactured as a single unit.

Embodiment 3

The valve as in any prior embodiment or combination of embodiments, wherein the connector and thrust sleeve are additively manufactured with a clearance between the thrust sleeve attachment feature and the pocket.

Embodiment 4

The valve as in any prior embodiment or combination of embodiments, wherein the connector and the thrust sleeve are inseparable.

Embodiment 5

The valve as in any prior embodiment or combination of embodiments, wherein the thrust sleeve attachment feature includes a first section and a second section having a longer radial length than the first section, and the thrust sleeve includes a pocket having a throat section and a receiving portion, the first section disposed in the throat section and the second section disposed in the receiving portion.

Embodiment 6

The valve as in any prior embodiment or combination of embodiments, wherein the thrust sleeve attachment feature and the pocket are substantially T-shaped.

Embodiment 7

The valve as in any prior embodiment or combination of embodiments, wherein load transfer between the thrust sleeve attachment feature and the thrust sleeve is symmetrically dispersed.

Embodiment 8

The valve as in any prior embodiment or combination of embodiments, wherein the pocket extends concentrically within the thrust sleeve.

Embodiment 9

The valve as in any prior embodiment or combination of embodiments, wherein the thrust sleeve attachment feature is arc shaped having an arc length less than a circumferential length of the pocket.

Embodiment 10

The valve as in any prior embodiment or combination of embodiments, further comprising a flow path, a flow path blocking member biased to block the flow path, and a piston chamber housing the piston, wherein a predetermined amount of hydraulic pressure or greater within the piston chamber longitudinally moves the piston, the coupling, and the flow tube in a first longitudinal direction, and the flow tube opens the flow path blocking member to unblock the flow path.

Embodiment 11

The valve as in any prior embodiment or combination of embodiments, further comprising a power spring, the power spring moving the flow tube and the piston in a second longitudinal direction opposite the first longitudinal direction when less than the predetermined amount of hydraulic pressure is applied to the piston chamber.

Embodiment 12

The valve as in any prior embodiment or combination of embodiments, further comprising a piston chamber having a longitudinal axis in parallel with a longitudinal axis of the valve and radially distanced from the longitudinal axis of the valve.

Embodiment 13

The valve as in any prior embodiment or combination of embodiments, wherein the valve is a tubing retrievable safety valve configurable for a downhole system.

Embodiment 14

A method of forming a valve includes additively manufacturing a valve coupling with a connector and a thrust sleeve, the connector having a piston attachment feature and a thrust sleeve attachment feature, and the thrust sleeve having a pocket, the thrust sleeve attachment feature formed within the pocket during additive manufacturing of the valve coupling; attaching the piston attachment feature to a piston; and attaching the thrust sleeve to a lower coupling; wherein the valve coupling transfers longitudinal movement between the piston and flow tube and enables rotational movement of the flow tube with respect to the piston.

Embodiment 15

The method as in any prior embodiment or combination of embodiments, wherein the thrust sleeve includes portions disposed radially interiorly and radially exteriorly of the thrust sleeve attachment feature.

Embodiment 16

The method as in any prior embodiment or combination of embodiments, wherein additively manufacturing the connector and thrust sleeve includes forming a clearance between the thrust sleeve attachment feature and the pocket.

Embodiment 17

The method as in any prior embodiment or combination of embodiments, wherein the thrust sleeve attachment feature and the pocket are T-shaped to trap the feature inseparably within the pocket.

Embodiment 18

The method as in any prior embodiment or combination of embodiments, wherein the thrust sleeve attachment feature is formed within a subsection of the pocket and the pocket is substantially empty.

Embodiment 19

The method as in any prior embodiment or combination of embodiments, wherein attaching the piston attachment feature to the piston includes threading and attaching the thrust sleeve to the lower coupling includes threading.

Embodiment 20

The method as in any prior embodiment or combination of embodiments, further comprising arranging a power spring to bias the flow tube in a longitudinal direction, wherein the power spring imparts linear and incidental rotational movement to the flow tube during movement of the flow tube in the longitudinal direction.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A valve comprising:
- a piston;
- a flow tube; and
- a coupling transferring longitudinal movement between the piston and flow tube and enabling rotational movement of the flow tube with respect to the piston, the coupling including:
  - a connector having a piston attachment feature and a thrust sleeve attachment feature, the piston attachment feature attached to the piston, and
  - a thrust sleeve having a pocket, the thrust sleeve attachment feature disposed within the pocket, the thrust sleeve including portions disposed radially interiorly and radially exteriorly of the thrust sleeve attachment feature.

2. The valve of claim 1, wherein the connector and the thrust sleeve are additively manufactured as a single unit.

3. The valve of claim 2, wherein the connector and thrust sleeve are additively manufactured with a clearance between the thrust sleeve attachment feature and the pocket.

4. The valve of claim 1, wherein the connector and the thrust sleeve are inseparable.

5. The valve of claim 1, wherein the thrust sleeve attachment feature includes a first section and a second section having a longer radial length than the first section, and the pocket has a throat section and a receiving portion, the first section disposed in the throat section and the second section disposed in the receiving portion.

6. The valve of claim 1, wherein the thrust sleeve attachment feature and the pocket are substantially T-shaped.

7. The valve of claim 1, wherein load transfer between the thrust sleeve attachment feature and the thrust sleeve is symmetrically dispersed.

8. The valve of claim 1, wherein the pocket extends concentrically within the thrust sleeve.

9. The valve of claim 8, wherein the thrust sleeve attachment feature is arc shaped having an arc length less than a circumferential length of the pocket.

10. The valve of claim 1, further comprising a flow path, a flow path blocking member biased to block the flow path, and a piston chamber housing the piston, wherein a predetermined amount of hydraulic pressure or greater within the piston chamber longitudinally moves the piston, the coupling, and the flow tube in a first longitudinal direction, and the flow tube opens the flow path blocking member to unblock the flow path.

11. The valve of claim 10, further comprising a power spring, the power spring moving the flow tube and the piston in a second longitudinal direction opposite the first longitudinal direction when less than the predetermined amount of hydraulic pressure is applied to the piston chamber.

12. The valve of claim 1, further comprising a piston chamber having a longitudinal axis in parallel with a longitudinal axis of the valve and radially distanced from the longitudinal axis of the valve.

13. The valve of claim 1, wherein the valve is a tubing retrievable safety valve configurable for a downhole system.

14. A method of forming a valve, the method comprising:

manufacturing a unitary valve coupling having a connector integrally formed with a thrust sleeve, the connector having a piston attachment feature and a thrust sleeve attachment feature, and the thrust sleeve having a pocket, the thrust sleeve attachment feature being inseparably formed within the pocket during manufacturing of the valve coupling;

attaching the piston attachment feature to a piston; and attaching the thrust sleeve to a lower coupling;

wherein the valve coupling transfers longitudinal movement between the piston and flow tube and enables rotational movement of the flow tube with respect to the piston.

15. The method of claim 14, wherein the thrust sleeve includes portions disposed radially interiorly and radially exteriorly of the thrust sleeve attachment feature.

16. The method of claim 14, wherein additively manufacturing the connector and thrust sleeve includes forming a clearance between the thrust sleeve attachment feature and the pocket.

17. The method of claim 14, wherein the thrust sleeve attachment feature and the pocket are T-shaped.

18. The method of claim 14, wherein the thrust sleeve attachment feature is formed within a subsection of the pocket and the pocket is substantially empty.

19. The method of claim 14, wherein attaching the piston attachment feature to the piston includes threading and attaching the thrust sleeve to the lower coupling includes threading.

20. The method of claim 14, further comprising arranging a power spring to bias the flow tube in a longitudinal direction, wherein the power spring imparts linear and incidental rotational movement to the flow tube during movement of the flow tube in the longitudinal direction.

* * * * *